US007401946B2

(12) United States Patent
Laukhuf

(10) Patent No.: US 7,401,946 B2
(45) Date of Patent: Jul. 22, 2008

(54) MODULAR WIRING FOR LINEAR LIGHTING

(75) Inventor: Gregg E Laukhuf, Bryan, OH (US)

(73) Assignee: Pent Technologies, Inc., Kendallville, IN (US)

( * ) Notice: Subject to any disclaimer, the term of this patent is extended or adjusted under 35 U.S.C. 154(b) by 0 days.

(21) Appl. No.: 11/175,538

(22) Filed: Jul. 6, 2005

(65) Prior Publication Data

US 2006/0009071 A1 Jan. 12, 2006

Related U.S. Application Data

(60) Provisional application No. 60/585,886, filed on Jul. 7, 2004.

(51) Int. Cl.
*F21V 21/26* (2006.01)
*F21S 4/00* (2006.01)
*H01R 11/00* (2006.01)

(52) U.S. Cl. ..... 362/270; 362/219; 362/652; 439/502

(58) Field of Classification Search ..... 362/219, 362/221, 225, 226, 260, 457, 270, 133, 652; 439/502

See application file for complete search history.

(56) References Cited

U.S. PATENT DOCUMENTS

| | | | | |
|---|---|---|---|---|
| 4,415,217 | A | 11/1983 | Clabburn et al. | 339/113 |
| 4,639,841 | A | 1/1987 | Salestrom et al. | 362/227 |
| 5,226,724 | A | 7/1993 | Kanarek | 362/260 |
| 5,559,681 | A | 9/1996 | Duarte | 362/252 |
| 5,679,023 | A | 10/1997 | Anderson, Jr. et al. | 439/502 |
| 5,702,176 | A * | 12/1997 | Engle | 362/219 |
| 6,422,891 | B1 | 7/2002 | Huang | 439/367 |
| 6,641,294 | B2 * | 11/2003 | Lefebvre | 362/544 |
| 6,659,622 | B2 | 12/2003 | Katogi et al. | 362/219 |
| 6,702,453 | B2 * | 3/2004 | Weedon | 362/219 |
| 6,932,495 | B2 * | 8/2005 | Sloan et al. | 362/294 |
| 6,964,504 | B2 * | 11/2005 | Newbold | 362/375 |
| 2001/0036070 | A1 | 11/2001 | Compagnucci | 362/127 |
| 2003/0223235 | A1 | 12/2003 | Mohacsi et al. | 362/240 |

* cited by examiner

*Primary Examiner*—John A Ward
(74) *Attorney, Agent, or Firm*—Taylor & Aust, P.C.

(57) ABSTRACT

An electrical interconnection system for linear lighting including a first electrical harness having a first electrical connector with a first plurality of terminals, and a first plurality of electrical conductors electrically connected to respective first terminals. A second electrical harness includes a second electrical connector with a second plurality of terminals, and a second plurality of electrical conductors electrically connected to respective second terminals. The second plurality of terminals are similar in shape to the first plurality of terminals. The first and second electrical harnesses are configured for connection to a first and second linear light, respectively. An electrical coupler is electrically connected to both the first electrical connector and the second electrical connector and includes a first port and a second port which each have a plurality of coupler terminals complimentary in shape with the first plurality of terminals and the second plurality of terminals.

14 Claims, 3 Drawing Sheets

MODULAR WIRING FOR LINEAR LIGHTING

CROSS REFERENCE TO RELATED APPLICATIONS

This is a non-provisional application based upon U.S. provisional patent application Ser. No. 60/585,886, entitled "MODULAR WIRING FOR LINEAR LIGHTING", filed Jul. 7, 2004.

BACKGROUND OF THE INVENTION

1. Field of the Invention

The present invention relates to lighting systems, and, more particularly, to modular wiring for linear lighting systems.

2. Description of the Related Art

Lighting systems are known which use a relatively long and narrow light source such as a fluorescent tube. Other lighting systems are known which array multiple light sources generally in a line, or which array multiple light fixtures, each having at least one light source, generally in a line. Such systems are considered linear lighting systems and can be used in residential applications to provide lighting solutions for kitchens, such as under cabinets, cove lighting, over center islands, work stations and counter areas; and/or for entertainment and media rooms, and for highlighting unique and beautiful objects, for example. Commercial uses of linear lighting systems include the lighting of either office or industrial work areas, warehouses, distribution centers, retail space and the like. Linear lighting systems can be direct lighting systems or indirect lighting systems. Architectural linear lighting can be used to evenly illuminate work or retail space, walls, ceilings or floors. Typical linear lighting systems can include suspended light fixtures ordered in lengths, and ordering by the length of the fixture can provide fewer mounting locations to install. Additionally, the individual fixtures can be interconnected for functional or aesthetic reasons, and also to minimize mounting hardware and installation time. The suspended approach gives the opportunity for indirect and direct/indirect lighting, brightening up the space and eliminating a dark ceiling. The lengths of fixtures can also create a unique architectural element to the space being lighted, and further, can provide the ability to create space frames and other unique forms. Linear lighting systems are not necessarily suspended but can also be mounted in ceilings, on walls, on the underside of cabinets, or in architectural elements such as cornices, canopies and the like. Linear lighting systems are not restricted to using fluorescent light sources, but instead, can use other light sources such as light emitting diodes (LEDs), for example.

In contrast, non-linear lighting includes fixtures which are not connected, which do not light as much area as an appropriate linear light, and which are installed separately, typically resulting in extra fixtures when compared to linear lighting and more mounting hardware and more power feeds. The non-linear lighting therefore often translates into extra installation time and cost, may not be as pleasingly aesthetic, and/or may not provide as uniform lighting when compared to a linear light system.

One problem with known linear lighting systems is that if each individual fixture has its own power infeed (three conductors: line, neutral and ground, for example), time and material is wasted during installation to separately wire electrical power to each fixture. To avoid this problem, some linear lighting systems include wiring to interconnect multiple fixtures in parallel, or "daisy-chained", thereby minimizing the number of power infeeds. One problem with this type of design is that each fixture, in order to interconnect correctly with an adjoining fixture, needs to be mounted in one of two orientations. That is, the electrical interconnections between adjacent linear lighting fixtures is directional where the interconnection at one end of a fixture can only be connected with one of two ends of an adjoining fixture. While this type of design may improve manufacturing efficiencies of the fixtures, it also disadvantageously creates problems during installation, repair and/or replacement in that a linear light fixture can be mechanically installed incorrectly in the wrong one of two orientations thereby not allowing electrical interconnection of adjoining fixtures. The wrongly orientated fixture must then be uninstalled and reinstalled in the correct orientation. The corrective process of uninstalling wrongly oriented fixtures and then reinstalling the same fixture in the correct orientation can be costly, time consuming and frustrating for installation personnel and/or customers of the linear lighting systems, particularly when a large area having many linear light fixtures is being installed. Another problem with known systems is that the electrical interconnection between fixtures can be unsightly, or can be required to be installed in a conduit for example, which takes away from the attractiveness of the fixture and/or adds to the cost of the fixture, particularly installation costs. Another problem with known systems is that the electrical interconnection can be direct hardwiring of adjoining fixtures which is time consuming during installation and therefore costly. Another problem with known linear lighting systems, including multiple linear light fixtures, is that the fixtures must be fully mechanically installed to complete the electrical interconnection, and therefore the mechanical installation must be complete prior to electrical testing. If a fixture does not operate as intended, mechanical disassembly with other fixtures must be undertaken in order to correct the electrical malfunction.

What is needed in the art is an apparatus and method of electrically interconnecting linear light fixtures which is not directional, which does not require hardwiring together adjacent fixtures, which can electrically power fixtures without complete mechanical assembly of the linear light system, and which can conceal electrical interconnection between fixtures.

SUMMARY OF THE INVENTION

The present invention provides a non-directional modular wiring system for linear lighting.

The invention comprises, in one form thereof, a modular electrical interconnection system for linear lighting, the electrical interconnection system including a first electrical harness having a first electrical connector with a first plurality of terminals, and a first plurality of electrical conductors electrically connected to respective ones of the first plurality of terminals. The first electrical harness is configured for connection to a linear light. A second electrical harness includes a second electrical connector with a second plurality of terminals, and a second plurality of electrical conductors electrically connected to respective ones of the second plurality of terminals. The second plurality of terminals are similar in shape to the first plurality of terminals. The second electrical harness is configured for connection to another linear light. An electrical coupler is electrically connected to both the first electrical connector and the second electrical connector. The electrical coupler includes a first port and a second port where each of the first port and the second port has a plurality of coupler terminals complimentary in shape with the first plurality of terminals and the second plurality of terminals. The plurality of coupler terminals associated with the first port are electrically connected to respective ones of the plurality of coupler terminals associated with the second port.

The invention comprises, in another form thereof, a linear lighting system having a first linear light fixture including a first light source and a first electrical harness electrically connected to the first light source. The first electrical harness has a first electrical connector with a first plurality of terminals, and a first plurality of electrical conductors electrically connected to respective ones of the first plurality of terminals. An electrical coupler is electrically connected to the first electrical connector where the electrical coupler includes a first port and a second port. Each of the first port and the second port includes a plurality of coupler terminals complimentary in shape with the first plurality of terminals. The plurality of coupler terminals associated with the first port are electrically connected to respective ones of the plurality of coupler terminals associated with the second port.

The invention comprises, in another form thereof, a method of electrically connecting a linear lighting system, the method including the steps of: providing a first linear light fixture including a first light source and a first electrical harness electrically connected to the first light source, the first electrical harness having a first electrical connector with a first plurality of terminals, and a first plurality of electrical conductors electrically connected to respective ones of the first plurality of terminals; providing an electrical coupler, the electrical coupler including a first port and a second port, each of the first port and the second port including a plurality of coupler terminals complimentary in shape with the first plurality of terminals, the plurality of coupler terminals associated with the first port being electrically connected to respective ones of the plurality of coupler terminals associated with the second port; electrically connecting the electrical coupler to the first electrical connector; providing a second linear light fixture having a second light source and second electrical harness electrically connected to the second light source, the second electrical harness including a second electrical connector with a second plurality of terminals, and a second plurality of electrical conductors electrically connected to respective ones of the second plurality of terminals, the second plurality of terminals similar in shape to the first plurality of terminals; and electrically connecting the second connector to the electrical coupler.

An advantage of the present invention is that it does not matter which end of a linear light fixture gets mounted toward the power source.

Another advantage of the present invention is that it provides a modular wiring for linear lighting.

Yet another advantage of the present invention is that it provides an apparatus and method of electrically interconnecting linear light fixtures which is not directional.

Yet another advantage of the present invention is that it does not require hardwiring together adjacent fixtures.

Yet another advantage of the present invention is that it electrically powers linear light fixtures without complete mechanical assembly of the linear light system.

Yet another advantage of the present invention is that it can conceal electrical interconnection between fixtures.

Yet another advantage of the present invention is that it provides for electrically testing linear light fixtures without complete mechanical assembly of the linear light system.

BRIEF DESCRIPTION OF THE DRAWINGS

The above-mentioned and other features and advantages of this invention, and the manner of attaining them, will become more apparent and the invention will be better understood by reference to the following description of embodiments of the invention taken in conjunction with the accompanying drawings, wherein.

Corresponding reference characters indicate corresponding parts throughout the several views. The exemplifications set out herein illustrate one preferred embodiment of the invention, in one form, and such exemplifications are not to be construed as limiting the scope of the invention in any manner.

DETAILED DESCRIPTION OF THE INVENTION

Figure 1:
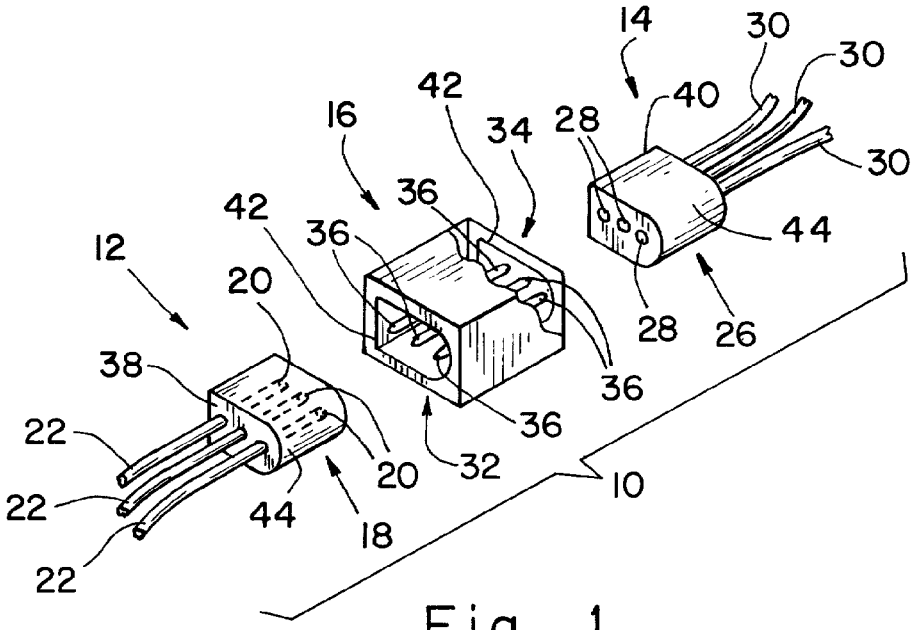
FIG. 1 is an exploded fragmentary perspective view of an embodiment of a modular electrical interconnection system for linear lighting according to the present invention.

Referring now to the drawings, and more particularly to FIG. 1, there is shown a modular electrical interconnection system 10 for linear lighting which generally includes a first electrical harness 12, a second electrical harness 14 and an electrical coupler 16 which can be electrically connected to both first electrical harness 12 and second electrical harness 14.

First electrical harness 12 includes a first electrical connector 18 with a first plurality of terminals 20, and a first plurality of electrical conductors 22 electrically connected to respective ones of first terminals 20. That is, terminals 20 are typically connected to conductors 22 on a one to one basis where a single conductor 22 is connected exclusively to a single terminal 20, although other configurations are possible depending on the type of electrical energy/signals conducted on conductors 22. Although three conductors 22 are shown corresponding to three terminals 20, which can be suitable for power conductors (one line, one neutral and one ground), the number of conductors 22 and terminals 20 can vary depending on the function of the linear light, and can include other power conductors, control signal conductors and data conductors, for example. First electrical harness 12 is configured for connection to a linear light 24 as shown in FIG. 3.

Second electrical harness 14 includes a second electrical connector 26 with a second plurality of terminals 28, and a second plurality of electrical conductors 30 electrically connected to respective ones of second terminals 28. As with terminals 20 and conductors 22, terminals 28 are typically connected to conductors 30 on a one to one basis where a single conductor 30 is connected exclusively to a single terminal 28, although other configurations are possible depending on the type of electrical energy/signals conducted on conductors 30. Although three conductors 30 are shown corresponding to three terminals 28, which can be suitable for power conductors (one line, one neutral and one ground), the number of conductors 30 and terminals 28 can vary depending on the function of the linear light, and can include other power conductors, control signal conductors and data conductors, for example. Second terminals 28 are similar in shape to first terminals 20, both individually and collectively.

Figure 3:
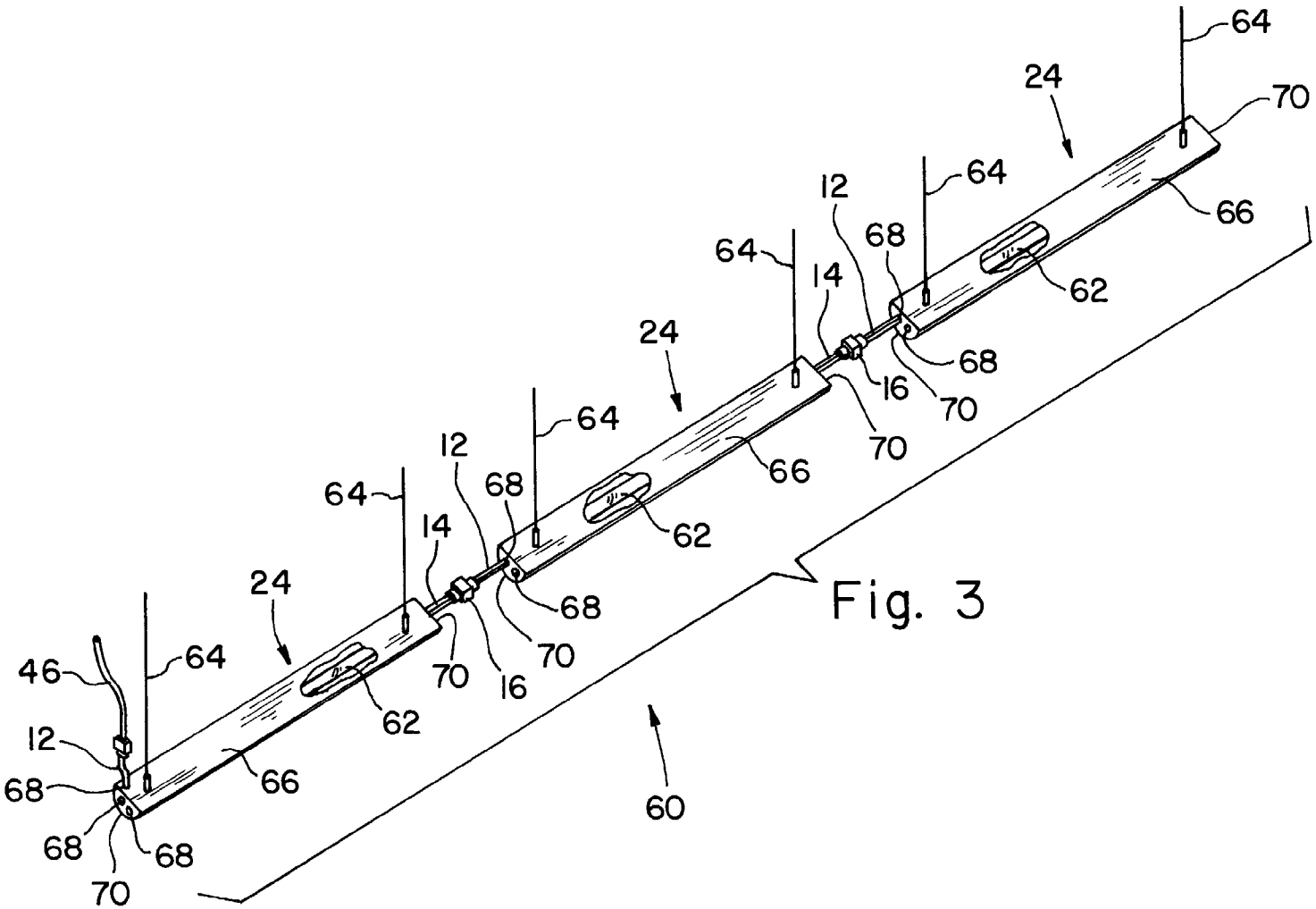
FIG. 3 is a fragmentary perspective view of an embodiment of a linear lighting system according to the present invention and shown prior to abutting the light fixtures together.

Second electrical harness 14 is configured for connection to another linear light 24, as shown in FIG. 3.

Electrical coupler 16 is electrically configured for connection to both first electrical connector 18 and second electrical connector 26. Electrical coupler 16 includes a first port 32 and a second port 34. Each of first port 32 and second port 34 includes a plurality of coupler terminals 36 complimentary in shape with first terminals 20 and second terminals 28. Coupler terminals 36 associated with first port 32 are electrically connected to respective ones of coupler terminals 36 associated with second port 34.

A first housing 38 is associated with first connector 18 and a second housing 40 is associated with second connector 26. Each of first port 32 and second port 34 includes a keyway 42, and each of first housing 38 and second housing 40 includes an outside contour 44 with a shape complimentary with keyway 42.

Each of first electrical connector 18 and second electrical connector 26 can be a female electrical connector as shown, with first terminals 20 and second terminals 28 comprising a plurality of female terminals as shown. Coupler terminals 36 are correspondingly a plurality of male coupler terminals, as shown, and complimentary in shape with the female terminals 20, 28. Alternatively, connectors 18 and 26 can be a male electrical connector with male terminals and coupler terminals 36 can be female terminals.

Figure 2:
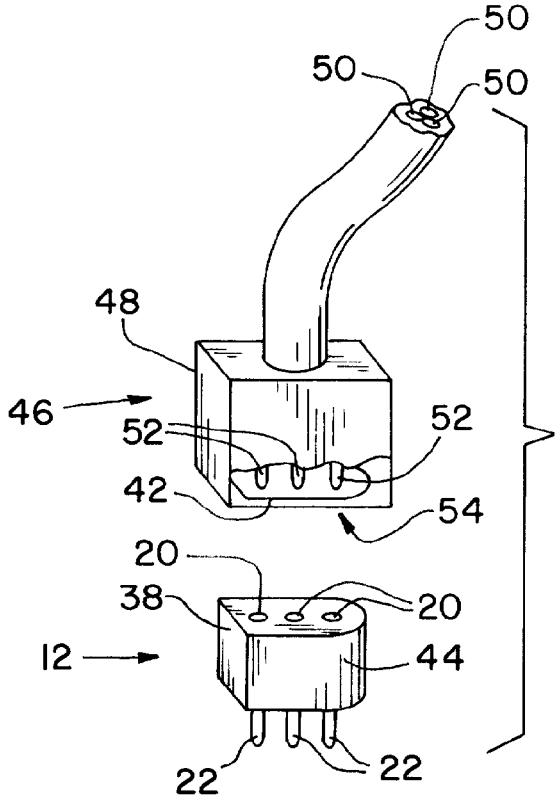
FIG. 2 is an exploded fragmentary perspective view of an embodiment of a power infeed according to the present invention.

A power infeed 46 (FIG. 2) includes a power connector 48, a plurality of power conductors 50 and a plurality of power terminals 52 associated with power connector 48 where each of power terminals 52 are electrically connected to a respective one of power conductors 50. Power connector 48 includes a power port 54 with a keyway 42 which is complimentary in shape with outside contour 44 of first housing 38 and second housing 40. Power infeed 46 is shown as having three conductors 50; however, the number of conductors 50 can vary and can be increased to include multiple power circuits, for example.

Figure 4:
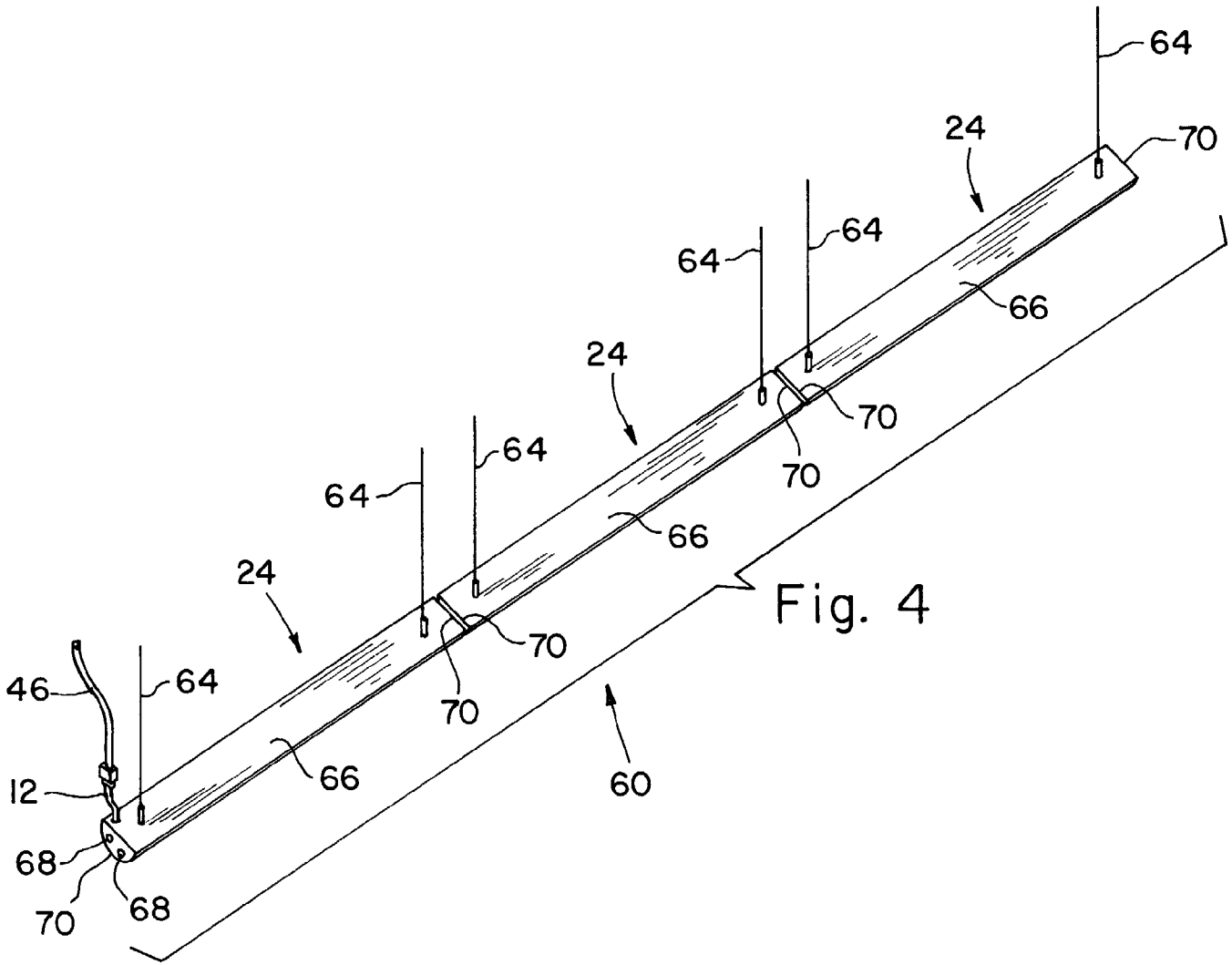
FIG. 4 is a perspective view of the linear lighting system of FIG. 3 shown after abutting the light fixtures together.

An embodiment of a linear lighting system 60 is shown in FIGS. 3 and 4 which includes a first linear light fixture 24 with a light source 62 and at least on electrical harness 12 and/or 14 electrically connected to light source 62. Electrical coupler 16 is electrically connected to one of connectors 18 and 26 of the first linear light fixture 24. Linear lighting system 60 can further include a second linear light fixture 24 having a second light source 62 with at least one electrical harness 12 and/or 14 electrically connected to light source 62. The electrical harness of the second linear light fixture 24 includes a second electrical connector 26 electrically connected to electrical coupler 16. Light sources 62 are shown as a fluorescent tube for example; however, other types of light sources are possible as are known in the art. Further, each of fixtures 24 can include other power circuits, ballasts and/or other power conditioning circuits, controls circuits and data circuits and/or other circuits as are known in the art. Fixtures 24 are shown as being suspended using hangars 64; however, fixtures can be embodied as other types of linear light fixtures as are known in the art. Each of fixtures 24 can include a fixture housing 66 with cutouts 68 for ingress and egress of harnesses 12, 14 and couplers 16.

In use, the present invention provides a method of electrically connecting and powering a linear lighting system 60 including the steps of: providing a first linear light fixture 24 including a first electrical harness 12 electrically connected to a first light source 62 and having a first electrical connector 18; providing an electrical coupler 16; electrically connecting electrical coupler 16 to first electrical connector 18; providing a second linear light fixture 24 including a second electrical harness 14 electrically connected to a second light source 62 and having a second electrical connector 26; and electrically connecting second connector 26 to electrical coupler 16. The method of the present invention can further include the step of abutting an end 70 of the first linear light fixture 24 against an end 70 of a said second linear light fixture. The method of the present invention can further include the step of concealing first electrical harness 12, electrical coupler 16 and second electrical harness 26 within at least one of the first linear light fixture 24 and the second linear light fixture 24 as shown particularly in FIG. 4.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. A linear lighting system, comprising:

a first linear light fixture including a first light source and a first electrical harness electrically connected to said first light source, said first electrical harness having a first electrical connector with a first plurality of terminals, and a first plurality of electrical conductors electrically connected to respective ones of said first plurality of terminals; and an electrical coupler electrically connected to said first electrical connector, said electrical coupler including a first port and a second port, each of said first port and said second port including a plurality of coupler terminals complimentary in shape with said first plurality of terminals, said plurality of coupler terminals associated with said first port being electrically connected to respective ones of said plurality of coupler terminals associated with said second port, said electrical coupler having an absence of a power port.

2. The linear lighting system of claim 1, further including a second linear light fixture having a second light source and second electrical harness electrically connected to said second light source, said second electrical harness including a second electrical connector with a second plurality of terminals, and a second plurality of electrical conductors electrically connected to respective ones of said second plurality of terminals, said second plurality of terminals similar in shape to said first plurality of terminals, said second connector electrically connected to said electrical coupler.

3. The linear lighting system of claim 2, further including a first housing associated with said first connector and a second housing associated with said second connector, each of said first port and said second port including a keyway, each of said first housing and said second housing including an outside contour with a shape complimentary with said keyway.

4. The linear lighting system of claim 2, wherein each of said first electrical connector and said second electrical connector are a female electrical connector, and each of said first plurality of terminals and said second plurality of terminals are a plurality of female terminals.

5. The linear lighting system of claim 4, wherein said plurality of coupler terminals are a plurality of male coupler terminals complimentary in shape with said plurality of female terminals.

6. The linear lighting system of claim 2, wherein said first linear light fixture includes a first fixture housing connected to said first light source, said second linear light fixture includes a second fixture housing connected to said second light source, said first electrical harness, said second electrical harness and said electrical coupler are concealed within at least one of said first fixture housing and said second fixture housing when said first fixture housing is butted together with said second fixture housing.

7. The linear lighting system of claim 2, further including a power infeed having a power connector, a plurality of power conductors and a plurality of power terminals associated with said power connector where each of said plurality of power terminals are electrically connected to a respective one of said plurality of power conductors, said power connector including a power port with a keyway, further including a first housing associated with said first connector and a second housing associated with said second connector, each of said first housing and said second housing including an outside contour with a shape complimentary with said keyway.

8. A method of electrically connecting a linear lighting system, the method comprising the steps of:

providing a first linear light fixture including a first light source and a first electrical harness electrically connected to said first light source, said first electrical harness having a first electrical connector with a first plurality of terminals, and a first plurality of electrical conductors electrically connected to respective ones of said first plurality of terminals;

providing an electrical coupler, said electrical coupler including a first port and a second port, each of said first port and said second port including a plurality of coupler terminals complimentary in shape with said first plurality of terminals, said plurality of coupler terminals associated with said first port being electrically connected to respective ones of said plurality of coupler terminals associated with said second port, said electrical coupler having an absence of a power port;

electrically connecting said electrical coupler to said first electrical connector;

providing a second linear light fixture having a second light source and second electrical harness electrically connected to said second light source, said second electrical harness including a second electrical connector with a second plurality of terminals, and a second plurality of electrical conductors electrically connected to respective ones of said second plurality of terminals, said second plurality of terminals similar in shape to said first plurality of terminals; and electrically connecting said second connector to said electrical coupler.

9. The method of claim 8, further including the step of abutting an end of said first linear light fixture against an end of said second linear light fixture.

10. The method of claim 8, further including the step of concealing said first electrical harness, said electrical coupler and said second electrical harness within at least one of said first linear light fixture and said second linear light fixture.

11. The linear lighting system of claim 1, wherein said first electrical harness includes only one electrical connector.

12. The linear lighting system of claim 1, wherein said electrical coupler is directly mechanically connected to said first electrical connector.

13. The method of claim 8, wherein said electrical coupler is directly mechanically connected to said first and said second electrical connectors.

14. The linear lighting system of claim 1, wherein said electrical coupler has an absence of a hardwire receiving station.

* * * * *